US005956850A

United States Patent [19]

Poulsen

[11] Patent Number: 5,956,850

[45] **Date of Patent: *Sep. 28, 1999**

[54] DISPOSABLE RAZOR WITH MEANS FOR RECORDING USAGE

[76] Inventor: Thomas Edward Poulsen, P.O. Box 281151, Lamoille, Nev. 89828

[ * ] Notice: Under 35 U.S.C. 154(b), the term of this patent shall be extended for 227 days.

[21] Appl. No.: 08/748,158

[22] Filed: Nov. 12, 1996

Related U.S. Application Data

[63] Continuation of application No. 08/483,281, Jun. 7, 1995, abandoned.

[51] Int. Cl.[6] ..... B26B 21/52

[52] U.S. Cl. ..... 30/41.7

[58] Field of Search ..... 30/41.7, 41.8, 30/537, 526; 116/278, 322, 323, 324

[56] References Cited

U.S. PATENT DOCUMENTS 5,062,209 11/1991 Rais ..... 30/41.7

*Primary Examiner*—Douglas D. Watts

[57] ABSTRACT

A disposable razor with means for recording usage including a blade cartridge portion and a handle portion, the handle portion including a sidewall with an inner and outer surface. A plurality of push tabs are located on the sidewall of the handle, the push tabs being bordered by one or more grooves formed into the inner and/or outer surface of the sidewall; or the push tabs are bordered by one or more grooves formed into one or both surfaces of the sidewall and one or more slits extending all the way through the sidewall. Pressure applied onto the outer surface of a push tab causes a portion of the push tab to break away from the remainder of the sidewall, leaving a visible "breakline", and so providing a means for recording a limited numerical quantity.

28 Claims, 3 Drawing Sheets

DISPOSABLE RAZOR WITH MEANS FOR RECORDING USAGE

This application is a continuation of U.S. patent application Ser. No. 08/483,281, now abandoned.

BACKGROUND OF THE INVENTION

This invention relates to disposable razors.

A common annoyance experienced by people who shave with disposable razors is not knowing how many times the razor has been used previously, and whether or not to discard it. Generally, the more times a razor is used, the less comfortable it is to shave with.

Much of this annoyance could be avoided if the disposable razor included a means for recording how many times it has been used. However, since cost is a very important factor of disposable razors, it is important that any such use recording feature add very little if anything to manufacturing costs.

Accordingly, it is an object of this invention to provide a disposable razor that has a feature to record how many times it has been used. Further, it is an object of this invention to provide such a disposable razor that can be manufactured inexpensively, adding little if anything to the manufacturing costs when compared to existing disposable razors. It is still a further object to provide such a razor that does not require that parts be broken or otherwise removed from the razor that must be disposed of separately from the razor itself.

SUMMARY OF THE INVENTION

In the several embodiments, the disposable razor includes push tabs formed into the handle so that external pressure applied onto a surface of a push tab, as applied with the user's finger or thumb, will cause a portion of the push tab to break away from the remainder of the handle leaving a visible "break line" that will serve to record a single usage. Ideally, the razor handle will be formed of plastic by the plastic injection molding process. In each of the embodiments shown, the handles (if formed of plastic) can be manufactured by the injection molding process in molds that do not require the use of "slides". Slides are a feature necessarily present on some (but not all) plastic injection molds. When slides must be used in an injection mold, the per part manufacturing cost of the item being molded are generally higher.

DETAILED DESCRIPTION

Figure 1:
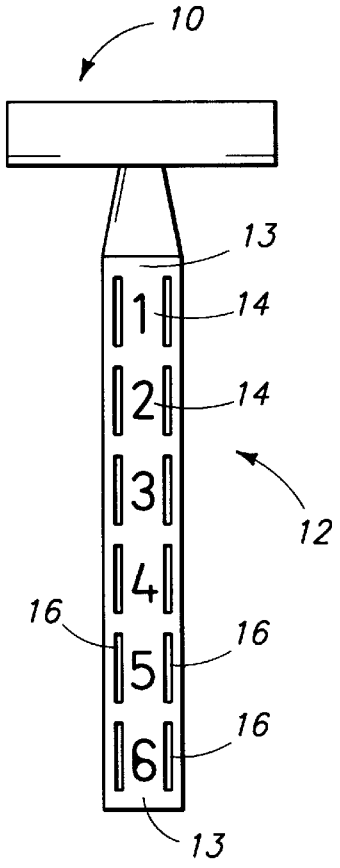
FIG. 1 is a top view of the disposable razor showing the push tabs for recording use on the handle.
Figure 2:
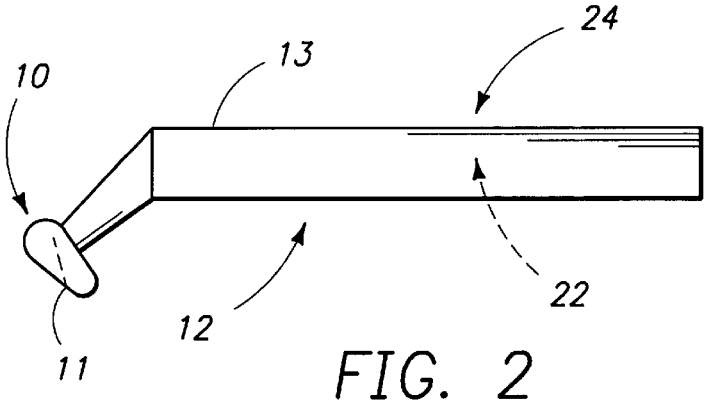
FIG. 2 is a side view of the disposable razor of FIG. 1.

As depicted in FIGS. 1 and 2, the disposable razor includes a blade cartridge portion 10 which includes one or more blades 11, and a handle, depicted generally as 12.

As best seen in FIG. 1, the rear sidewall 13 of the handle 12 includes a plurality of push tabs 14 that are formed into the rear sidewall 13. One such push tab 14 is shown in greater detail in FIG. 3. This embodiment of a push tab 14 includes two parallel slits 16 that extend all the way through the sidewall 13 of the handle 12. A groove 18 (shown in phantom in FIG. 3) connects the two upper ends of the two parallel slits 16. The groove 18 is formed into the inner surface 22 of the rear sidewall 13. Another groove 20 (also shown in phantom in FIG. 3) connects the two lower ends of the two parallel slits 16. Groove 20 is also formed into the inner surface 22 of the rear sidewall 13.

The push tabs 14 may, if desired, be numbered. (to avoid confusion, these numerals are not denoted by a reference character in the drawings).

Ideally, after each use of the disposable razor, the user pushes on the outer surface 24 of one of the push tabs 14, as with a finger or thumb. This causes the material (preferably plastic) adjacent to the groove 18 to break, leaving a visible "break line" which denotes a single use of the disposable razor. The material (as plastic) adjacent to the other groove 20, which is made thinner in cross-section due to the presence of the groove 20, does not break but rather bends in response to the pressure applied onto the push tab 14. Thus, the upper end of the push tab 14 (the end bordered by the groove 18) moves away from the sidewall 13 slightly as the handle material adjacent to groove 18 breaks.

Figure 3:
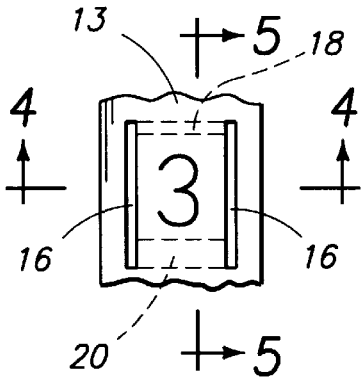
FIG. 3 is an enlarged view of a portion of the handle shown in FIG. 1, showing a single push tab in greater detail.
Figure 4:
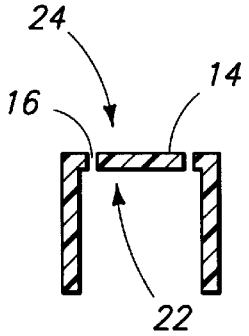
FIG. 4 is a cross-sectional view of the push tab of FIG. 3, taken along line 4—4 of FIG. 3.
Figure 5:
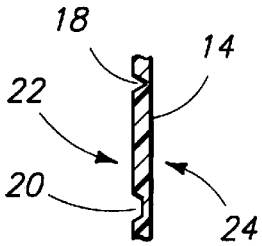
FIG. 5 is a cross-sectional view of the push tab of FIG. 3, taken along line 5—5 of FIG. 3.
Figure 6:
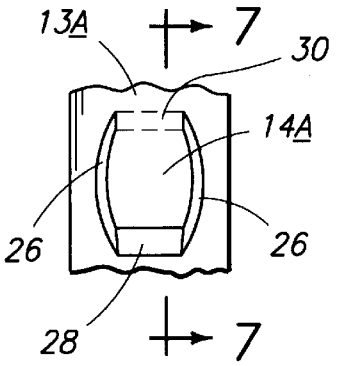
FIG. 6 is a top view of a second embodiment of a push tab, slightly different from the first embodiment, showing the push tab on a portion of the handle.
Figure 7:
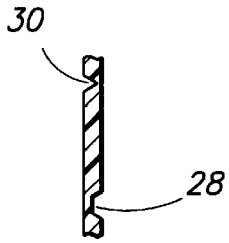
FIG. 7 is a cross-sectional view of the push tab of FIG. 6, taken along line 7—7 of FIG. 6.

FIG. 6 is a top view of another embodiment of a push tab, similar to the push tabs of FIGS. 3, 4 and 5, but where the slits 26 are curved in shape, and the groove 28 is formed into the outer surface of the sidewall 13A. This embodiment works similar to the embodiment shown in FIG. 3; the material adjacent to groove 30 breaks in response to pressure applied to the outer surface of the push tab 14A, while the material adjacent to groove 28 bends.

Figure 8:
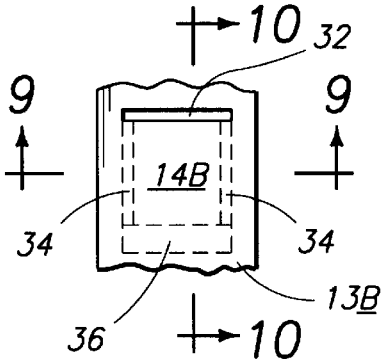
FIG. 8 is a top view of a third embodiment of a push tab.
Figure 9:
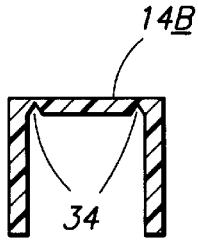
FIG. 9 is a cross-sectional view of the push tab of FIG. 8, taken along line 9—9 of FIG. 8.
Figure 10:
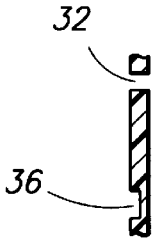
FIG. 10 is a cross-sectional view of the push tab of FIG. 8, taken along line 10—10 of FIG. 8.

FIG. 8 is a top view of a third embodiment of the push tab, while FIGS. 9 and 10 show the push tab in cross section. In this embodiment, the top of the push tab 14B (the portion closest to the razor cartridge) is bordered by a slit 32 that extends all the way through the sidewall 13B, while the sides and the bottom of the push tab 14B are bordered by grooves 34 and groove 36 respectfully (shown in phantom). Groves 34 and groove 36 are formed into the inner surface of the sidewall 13B.

Pressure applied to the outer surface of the push tab 14B causes the material of which the handle is formed (plastic for example) adjacent to grooves 34 to break, while the material adjacent to groove 36 bends. Two visible break lines denote a single usage of the disposable razor.

Figure 11:
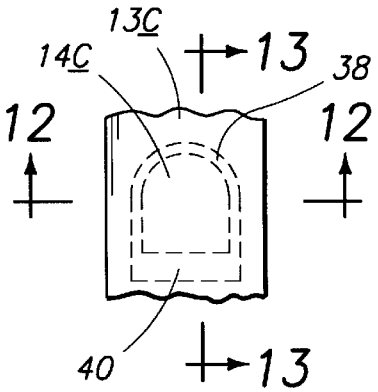
FIG. 11 is a top view of a fourth embodiment of a push tab.
Figure 12:
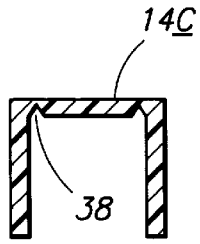
FIG. 12 is a cross-sectional view of the push tab of FIG. 11, taken along line 12—12 of FIG. 11.
Figure 13:
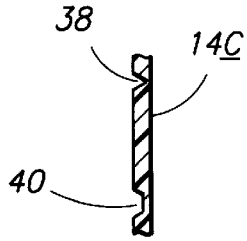
FIG. 13 is a cross-sectional view of the push tab of FIG. 11, taken along line 13—13 of FIG. 11.

FIGS. 11, 12 and 13 depicts a fourth embodiment of a push tab. In this embodiment, the push tab 14C is encircled by groove 38 and groove 40, both of which are formed into the inner surface of the sidewall 13C. While groove 40 is straight, groove 38 forms a modified semicircle connecting at either end to the ends of groove 40.

When pressure is applied onto the outer surface of the push tab 14C, the material adjacent to groove 38 breaks, while the material adjacent to groove 40 bends. A break line that traces the path of groove 38 denotes a single usage of the disposable razor. In this embodiment, the groove 38 could easily be replaced with three similar but straight grooves that would connect with groove 40 to enclose a square or rectangular shaped push tab.

If the disposable razor handles are formed of plastic, and produced in a plastic injection mold, all of the embodiments of push tabs shown or described herein can be formed with those handles as a single piece in a plastic injection mold. No additional steps are required to make the push tabs after the handles have been molded. And further, the plastic injection mold need not have a slide.

Figure 14:
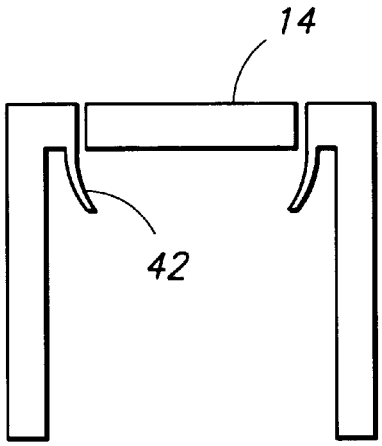
FIG. 14 is a cross-sectional view of a handle and a push tab with two projections included for holding the push tab away from the sidewall after it has been partially broken away from the sidewall.
Figure 16:
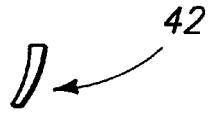
FIG. 16 shows a single projection as those of FIGS. 14 and 15.
Figure 15:
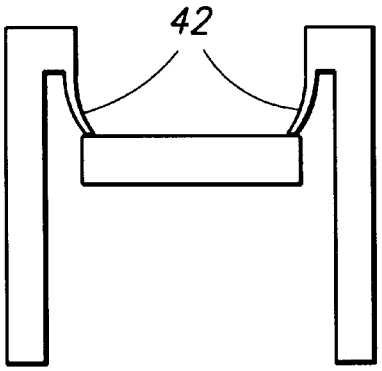
FIG. 15 Depicts the push tab of FIG. 14 as the end of that push tab is held away from the sidewall by two projections.
Figure 17:
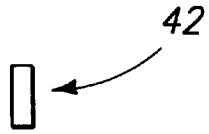
FIG. 17 depicts the projection of FIG. 16, shown from a position ninety degrees to the left or right from that of FIG. 16.

In order to provide a more visible indicator to denote usage, the portion of the push tabs that swing away from the sidewall in which they are formed, after breakage, could be held away from that sidewall by using one or more curved projections 42 as shown in FIGS. 14 and 15. These projections 42 (or projections similar to those depicted) can be formed with the handle in a plastic injection mold without a slide. This is possible because the plastic of the projections 42 bends as it is being removed from the injection mold, and then springs back to (or near to) its original position. The projections 42 are narrower (in one dimension) at their distal ends than at their base ends.

When the projections 42 are used, if the push tab 14 is pushed downward far enough, it "snaps" behind the one or more projections 42 which then prevents the end of the push tab 14 from moving back toward the sidewall, as illustrated in FIG. 15. Although FIGS. 14 and 15 depict an embodiment of a push tab similar to that of FIG. 3, these projections 42 (or similar projections) can be used with any of the embodiments of push tabs shown or described herein. Further, only one projection 42, (or a similar projection) may be used for each push tab rather than two, or more than two may be used for each push tab. Also, the one or more projections (as 42 or similar) need not necessarily be positioned along the sides or side of the push tab. For example, one or more such projections could be placed at the upper end of the push tab (the end that swings away from the sidewall).

The embodiments shown and described herein are general, and many variations of those embodiments are possible. For example, any of the grooves in the sidewall that enclose or partially enclose the push tabs could have intermittent spaces where holes or voids (slits) extend all the way through the sidewall, or any of the slits that are shown or described as extending all the way through the sidewall could have intermittent spaces where they do not extend all the way through the sidewall. Also, the shape or "course" of both the grooves and the slits (as straight or curved) can be changed from those in the drawings or description. Further, the number of grooves and/or slits that enclose or partially enclose the push tabs can also vary from those shown or described herein, and the placement of those grooves and slits relative to each other can also vary from those shown or described. Further, any of the grooves can be formed into either the inner or outer surface of the sidewall, regardless of how they may be shown or described herein.

While several embodiments and modifications thereto of the invention have been shown and described herein as best modes for carrying out the invention, it should be understood that changes and modifications may be made thereto without departing from the subject matter coming within the scope of the invention and the following claims.

I claim:

1. A disposable razor with means for recording usage, said razor including:

a) a blade cartridge portion including a blade;

b) a handle including a sidewall with an inner and outer surface;

c) a plurality of push tabs formed in said sidewall, each of said push tabs being at least partially bordered by (1) at least one flexible or bendable section of sidewall, and (2) at least one breakable section of sidewall, so that at least a portion of said breakable section of sidewall can be broken by applying pressure on the outer surface of said push tab, while said push tab remains connected with said handle by at least a portion of said flexible or bendable section, thus creating a visible breakage and providing the user with a means for recording a limited numerical quantity.

2. The disposable razor of claim 1, wherein said handle, including said push tabs, is plastic and is formed as a single piece in a plastic injection mold.

3. The disposable razor of claim 1, wherein said handle, including said push tabs, are plastic and are formed as a single piece in a plastic injection mold without a slide.

4. The disposable razor of claim 1, wherein at least some of said push tabs are numbered, the numbers being on or near said push tabs.

5. The disposable razor of claim 1, where an entire end portion of said push tabs can be broken free from adjacent sidewall, and further including a means for holding the free end of said push tabs away from said sidewall after said end portion has been broken free therefrom.

6. The disposable razor of claim 2, where an entire end portion of said push tabs can be broken free from adjacent sidewall, and further including a means for holding the free end of said push tabs away from said sidewall after said end portion has been broken free therefrom.

7. The disposable razor of claim 3, where an entire end portion of said push tabs can be broken free from adjacent sidewall, and further including a means for holding the free end of said push tabs away from said sidewall after said end portion has been broken free therefrom.

8. A disposable razor with means for recording usage, said razor including:

a) a blade cartridge portion including a blade;

b) a handle including a sidewall with an inner and outer surface;

c) a plurality of push tabs formed in said sidewall, each of said push tabs being at least partially bordered by (1) at least one flexible or bendable section of sidewall, and (2) at least one breakable section of sidewall, and (3) at least one slit extending all the way through said sidewall, so that at least a portion of said breakable section of sidewall can be broken by applying pressure on the outer surface of said push tab, while said push tab remains connected with said handle by at least a portion of said flexible or bendable section, thus creating a visible breakage and providing the user with a means for recording a limited numerical quantity.

9. The disposable razor of claim 8, wherein said handle, including said push tabs, is plastic and is formed as a single piece in a plastic injection mold.

10. The disposable razor of claim 8, wherein said handle, including said push tabs, is plastic and is formed as a single piece in a plastic injection mold without a slide.

11. The disposable razor of claim 8, wherein at least some of said push tabs are numbered, the numbers being on or near said push tabs.

12. The disposable razor of claim 8, where an entire end portion of said push tabs can be broken free from adjacent sidewall, and further including a means for holding the free end of said push tabs away from said sidewall after said end portion has been broken free therefrom.

13. The disposable razor of claim 9, where an entire end portion of said push tabs can be broken free from adjacent sidewall, and further including a means for holding the free end of said push tabs away from said sidewall after said end portion has been broken free therefrom.

14. The disposable razor of claim 10, where an entire end portion of said push tabs can be broken free from adjacent sidewall, and further including a means for holding the free end of said push tabs away from said sidewall after said end portion has been broken free therefrom.

15. A disposable razor including:

a) a razor cartridge portion including a blade;

b) a handle with a sidewall thereof having an inner and outer surface;

c) a plurality of push tabs formed in said sidewall, each of said push tabs being at least partially enclosed by (1) at least one flexible or bendable section of sidewall, and (2) at least one breakable section of sidewall, so that at least a portion of said breakable section of sidewall can be broken by applying pressure on the outer surface of said push tab, while said push tab remains connected with said handle by at least a portion of said flexible or bendable section, thus creating a visible breakage and providing the user with a means for recording a limited numerical quantity.

16. The disposable razor of claim 15, wherein said handle, including said push tabs, is plastic and is formed as a single piece in a plastic injection mold.

17. The disposable razor of claim 15, wherein said handle, including said push tabs, is plastic and is formed as a single piece in a plastic injection mold without a slide.

18. The disposable razor of claim 15, wherein at least some of said push tabs are numbered, the numbers being on or near said push tabs.

19. The disposable razor of claim 15, where an entire end portion of said push tabs can be broken free from adjacent sidewall, and further including a means for holding the free end of said push tabs away from said sidewall after said end portion has been broken free therefrom.

20. The disposable razor of claim 16, where an entire end portion of said push tabs can be broken free from adjacent sidewall, and further including a means for holding the free end of said push tabs away from said sidewall after said end portion has been broken free therefrom.

21. The disposable razor of claim 17, where an entire end portion of said push tabs can be broken free from adjacent sidewall, and further including a means for holding the free end of said push tabs away from said sidewall after said end portion has been broken free therefrom.

22. A disposable razor including:

a) a razor cartridge portion including a blade;

b) a handle with a sidewall thereof having an inner and outer surface;

c) a plurality of push tabs formed in said sidewall, each of said push tabs being at least partially enclosed by (1) at least one flexible or bendable section of sidewall, and (2) at least one breakable section of sidewall, and (3) at least one slit extending all the way through said sidewall, so that at least a portion of said breakable section of sidewall can be broken by applying pressure on the outer surface of said push tab, while said push tab remains connected with said handle by at least a portion of said flexible or bendable section, thus creating a visible breakage and providing the user with a means for recording a limited numerical quantity.

23. The disposable razor of claim 22, wherein said handle, including said push tabs, is plastic and is formed as a single piece in a plastic injection mold.

24. The disposable razor of claim 22, wherein said handle, including said push tabs, is plastic and is formed as a single piece in a plastic injection mold without a slide.

25. The disposable razor of claim 22, wherein at least some of said push tabs are numbered, the numbers being on or near said push tabs.

26. The disposable razor of claim 22, where an entire end portion of said push tabs can be broken free from adjacent sidewall, and further including a means for holding the free end of said push tabs away from said sidewall after said end portion has been broken free therefrom.

27. The disposable razor of claim 23, where an entire end portion of said push tabs can be broken free from adjacent sidewall, and further including a means for holding the free end of said push tabs away from said sidewall after said end portion has been broken free therefrom.

28. The disposable razor of claim 24, where an entire end portion of said push tabs can be broken free from adjacent sidewall, and further including a means for holding the free end of said push tabs away from said sidewall after said end portion has been broken free therefrom.

* * * * *